United States Patent [19]

Butterwick

[11] 4,370,585

[45] Jan. 25, 1983

[54] EVAPORATOR SUPPORT ASSEMBLY FOR A PHOTOMULTIPLIER TUBE

[75] Inventor: Gilbert N. Butterwick, Leola, Pa.

[73] Assignee: RCA Corporation, New York, N.Y.

[21] Appl. No.: 182,768

[22] Filed: Aug. 29, 1980

[51] Int. Cl.[3] ..... H01J 40/06

[52] U.S. Cl. ..... 313/102; 313/181

[58] Field of Search ..... 313/94, 181, 102; 316/5, 6

[56] References Cited

U.S. PATENT DOCUMENTS

| | | | |
|---|---|---|---|
| 2,404,803 | 7/1946 | Stafford | 313/181 X |
| 2,676,282 | 4/1954 | Polkosky | 313/102 |
| 3,502,928 | 3/1970 | Guyot et al. | 313/94 X |
| 3,658,400 | 4/1972 | Helvy | 313/94 |
| 3,753,023 | 8/1973 | Sommer | 313/103 |
| 3,884,539 | 5/1975 | Sommer | 316/6 |

*Primary Examiner*—Palmer C. Demeo

*Attorney, Agent, or Firm*—Eugene M. Whitacre; Glenn H. Bruestle; Vincent J. Coughlin, Jr.

[57] ABSTRACT

A photomultiplier tube comprises an evacuated envelope having a photoemissive cathode formed on an interior surface of the envelope. An evaporator support assembly is attached to a dynode assembly in such a manner as to align and precisely locate the dynode assembly with respect to the interior wall surface of the tube. The evaporator support assembly provides a structure for attaching an alkali source within the tube in a manner which guarantees mechanical and electrical reproducibility. The evaporator support structure also includes a structure for making contact to the photocathode of the tube.

10 Claims, 8 Drawing Figures

Fig. 1
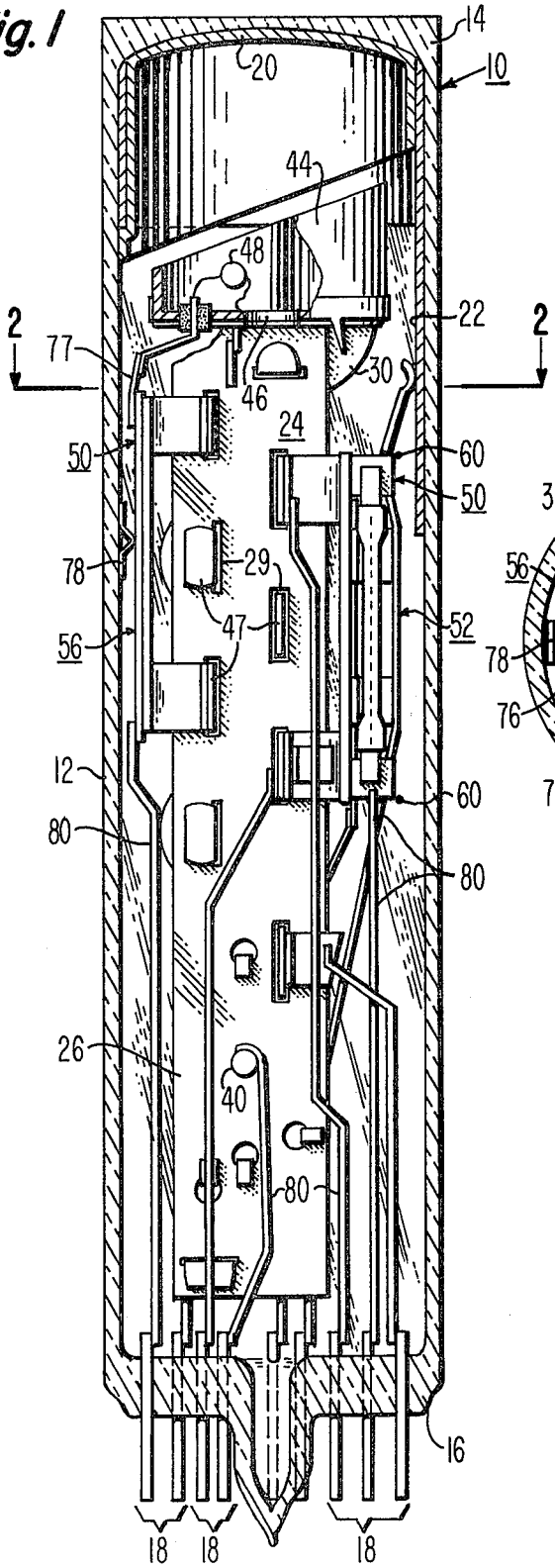
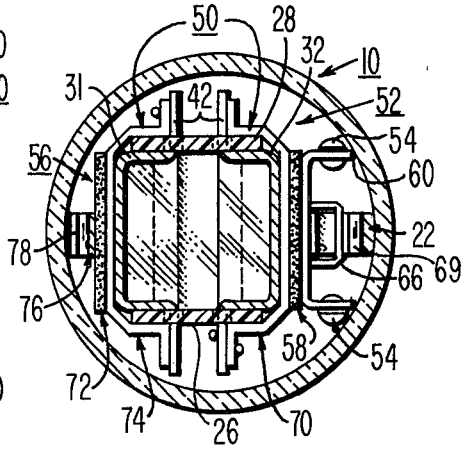
Fig. 2

Fig. 3
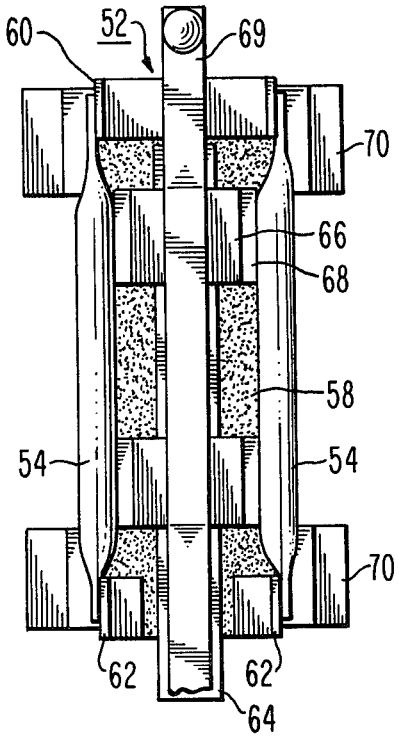
Fig. 4
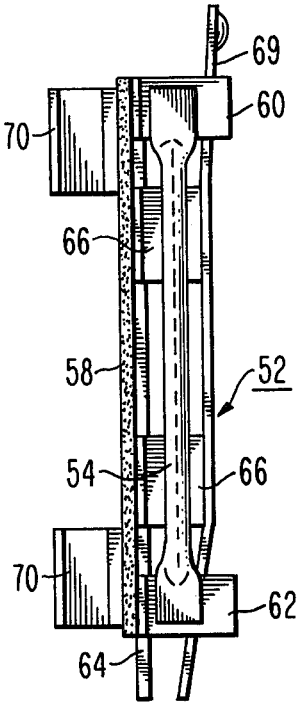
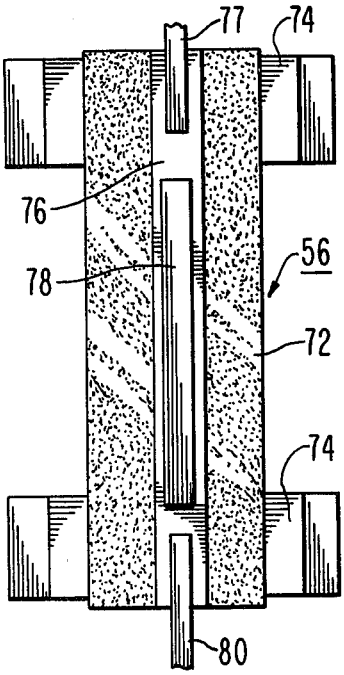
Fig. 5

Fig. 6
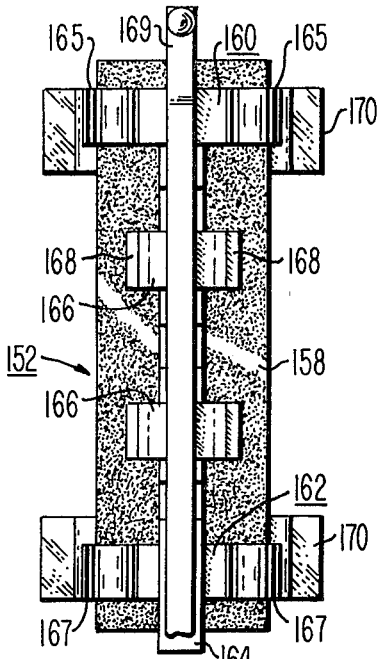
Fig. 8
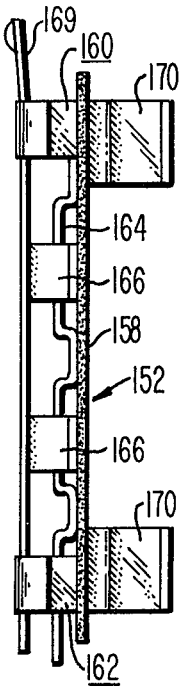
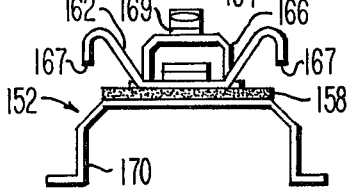
Fig. 7

EVAPORATOR SUPPORT ASSEMBLY FOR A PHOTOMULTIPLIER TUBE

BACKGROUND OF THE INVENTION

This invention relates to photomultiplier tubes and particularly to an evaporator support assembly for such a tube.

In the manufacturing of photomultiplier tubes, the reproducibility of uniform, high sensitivity photocathodes produced by the vapor deposition of at least one alkali metal on a suitable substrate is desirable. In the design of most photomultiplier tubes, a great deal of thought is given to the electron optics, dynode cage design, photocathode processing and parts cleaning procedures. However, the mechanics of tube assembly such as the insertion of one or more alkali evaporators, comprising an alkali metal chromate enclosed in a thin tantalum retainer seems, in most cases, to be left to chance, i.e., the alkali evaporators are placed in the tube wherever a convenient space for them may be found. Typically, the alkali evaporators are placed within the tube with little of the precision given to the placement of the other tube elements described above. As a result, the sensitivity of the photocathodes varies in uniformity and stability, due in large part to the non-precision of the evaporator placement.

It is thus desirable to precisely position the alkali evaporators within the tube so that they are mechanically and electrically substantially identically located from tube to tube in order to consistently reproduce high sensitivity photocathodes.

U.S. Pat. No. 3,753,023 to Sommer, issued Aug. 14, 1973, shows a typical photomultiplier tube in which the alkali evaporators are suspended adjacent to the dynode structure. The alkali evaporators are shown to be substantially unsupported and unrestricted within the tube. The electrical resistance of the evaporators, which comprises not only the resistance of the tantalum retainers but also the resistance of the attached lead wires connecting the ends of the evaporator retainers to the leads in the stem of the tube, varies from tube to tube. This variation is undesirable because the current at which the alkali vapors are emitted from the evaporators will also vary from tube to tube, thus creating processing differences between the tubes. These differences are undesirable and often result in substantial photocathode sensitivity variations between tubes processed by the same cathode processing operator.

An attempt to improve the cathode processing of tubes using resistance heated alkali metal evaporators is described in the copending U.S. patent application Ser. No. 025,559, abandoned, filed on Mar. 30, 1979, by Butterwick and assigned to the same assignee as the present invention and incorporated by reference herein. The Butterwick patent application describes a generator which contains alkali sources. The generator is mounted in the photomultiplier tube adjacent to the dynode assembly. The generator, however, serves as a receptacle for trapping particles of alkali metal powder and for directing the alkali metal evaporation substantially toward the cathode surface and does not precisely locate the evaporators mechanically or electrically within the tube. That is, the generator described in the copending patent application does not provide a structure that offers reproducible evaporation currents from tube to tube.

SUMMARY OF THE INVENTION

An electron discharge device comprises an evacuated envelope having an interior surface and a photomissive cathode within said envelope. An electrode assembly having at least one electrode is spaced from said cathode. An alkali metal source is contained within said envelope for vapor depositing at least one alkali metal to form said cathode. An evaporator support means, including at least one insulator support member, is attached to said electrode assembly for aligning said electrode assembly with respect to said interior envelope surface. Said evaporator support means includes at least one pair of electrical terminals attached to said insulator member.

BRIEF DESCRIPTION OF THE DRAWINGS

FIG. 1 is a sectional longitudinal view of a photomultiplier tube showing the novel evaporator support assembly;

FIG. 2 is a section view of the photomultiplier tube taken along line 2—2 of FIG. 1 and showing the evaporator support assembly in plan;

FIG. 3 is an enlarged plan view of a portion of the evaporator support assembly shown in FIGS. 1 and 2;

FIG. 4 is an elevation view of an evaporator support assembly shown in FIG. 3;

FIG. 5 is an enlarged plan view of another portion of the evaporator support assembly shown in FIGS. 1 and 2;

FIG. 6 is an enlarged plan view of a portion of an alternate embodiment of an evaporator support assembly;

FIG. 7 is an end view of the alternate embodiment of FIG. 6; and

FIG. 8 is an elevation view of the alternate embodiment of FIG. 6.

DETAILED DESCRIPTION OF THE PREFERRED EMBODIMENT

Referring to the drawings, there is shown in FIGS. 1 and 2 a photomultiplier tube 10 comprising an evacuated envelope 12 of generally cylindrical form having a transparent faceplate 14 and a stem 16, through which a plurality of conductive stem leads 18 are vacuum sealed. A photocathode 20 is formed on an interior surface of the faceplate 14. An aluminum coating 22 may be deposited on the upper inner surface of the envelope 12. The coating 22 makes electrical contact with the photocathode 20.

A dynode assembly, indicated generally as 24, is supported within the envelope 12 preferably by a pair of substantially parallel ceramic dynode support spacers 26 and 28, although other non-conductive dynode supporting structures may be used. Each of the dynode support spacers has a plurality of elongated apertures 29 extending therethrough. The dynode assembly 24 includes a plurality of staggered, serially aligned dynodes 30–39. Each of the dynodes has a secondary emissive surface for propagating and concatenating electron emission from the photocathode 20 to an anode 40 located within the last dynode 39 in the electron path. Each of the dynodes 30–39 may be formed of beryllium-copper, silver manganese or nickel coated with antimony, although beryllium-copper is preferred. Each of the dynodes 30–39 has a pair of oppositely disposed tabs 42 projecting from the ends of the dynodes. The tabs 42 extend through the aperture 29 in the dynode support spacers 26 and 28, respectively.

A shield 44 having an aperture 46 is placed intermediate the photocathode 20 and the dynode assembly 24 and maintained at a positive potential to enhance the collection and focusing of the photoelectrons emitted by the cathode 20 in response to incident radiation. One or more pellets 48 of an antimony alloy are suitably disposed around the shield 44 near the faceplate 14 for evaporating antimony onto the faceplate. A novel evaporator support assembly 50, including at least one source of alkali metal attached thereto, is disposed within the envelope 12.

After the envelope 12 is suitably evacuated, the antimony alloy pellets are heated to vaporize antimony onto the faceplate to the desired thickness or light transmission level in a method well known in the art. This antimony film is then exposed to vapors of one or more of the alkali metals contained within the tube to sensitize the antimony and form the photocathode. The evaporator support assembly 50 provides means for shielding the dynode assembly 24 thereby preventing excess alkali vapors from being deposited onto the individual dynode 30–39.

As shown in detail in FIGS. 2–5, the evaporator support assembly 50 comprises two discrete structures. A first evaporator structure 52 provides mechanical support and an electrical connection to the alkali sources which may be, for example, conventional tantalum channels 54. A second evaporator structure 56 is oppositely disposed from the first evaporator structure 52 and is designed to provide electrical connection to the antimony alloy pellet 48 which is located within the shield 44.

The first evaporator structure 52 comprises a first insulator member 58 which may be formed from a high alumina ceramic material. At least two spaced apart electrical terminals 60 and 62 are attached to one surface of the first insulator member 58, for example by brazing. In the preferred embodiment, the electrical terminal 60 is a U-shaped member attached at one end of the insulator member 58. The outwardly projecting edges of the U-shaped member 60 also act as bulb spacers to assist in positioning and aligning the structure 52 within the envelope. The electrical terminal 62 is an L-shaped bracket attached at the other end of the insulator member 58 adjacent the edge of the member. If it is desired to attach two tantalum channels 54 to the electrical terminals of the first evaporator structure 52, then a second electrical terminal 62 identical to the first terminal 62 is attached adjacent to but spaced from the first terminal 62. The L-shaped terminal 62 provides an upwardly directed portion on which one end of the tantalum channel 54 is attached. A return bus 64 is affixed to the surface of the insulator member 58 and contacts the portion of the U-shaped electrical terminal 60 that is in contact with the insulator member 58. The return bus 64 provides a return contact to permit evaporation of the alkali materials contained within the tantalum channels 54. Affixed to the insulator member 58 between and spaced from electrical terminals 60 and 62, is at least one cathode contact support member 66. The cathode contact support member 66 is an inverted U-shaped member having a pair of support tabs 68 which contact and are affixed to the insulator member 58. The cathode contact support member 66 is located in such a manner as to be electrically insulated from the electrical terminals 60 and 62 and to straddle the return bus 64. A cathode contact member 69 is attached to the support member 66 and contacts the aluminum 22 on the inner surface of the envelope 12. A pair of clamping members 70 are affixed to the opposite side of the insulator member 58. The clamping members 70 are formed so as to permit attachment to the tabs 42 projecting through the dynodes support spacers 26 and 28, respectively.

A second evaporator support structure 56 is disposed opposite to the first evaporator structure 52. The second evaporator structure 56 comprises a second insulator member 72 having a pair of clamping members 74 affixed to one surface thereof. The clamping members 74 are provided to permit the second evaporator structure 56 to be fixed to different ones of the dynode tabs 42 extending through the apertures 29 in the dynode support spacers 26 and 28. Affixed to an opposite side of the second evaporator support structure 56 is an antimony bus or contact member 76 which provides a return path for the evaporator current through the lead wire 77 connected to the antimony pellet 48 located within the shield 44. Attached to the antimony bus is a bulb spacing member 78 for mechanically aligning and spacing the second evaporator support member 56 from the interior surface of the envelope 12.

The combination of the first evaporator structure 52 and the second evaporator structure 56 which comprise the evaporator support assembly 50 provides a high degree of rigidity to the dynode assembly 24 by effectively clamping dynode assembly 24 between the clamping members 70 and 74, respectively, of the first and second evaporator structures. The upright projections on electrical terminals 60 and 62 on the first evaporator structure 52 furthermore provide and maintain proper spacing between the dynode assembly 24 and the interior surface of the envelope 12. The upright portions of the aforementioned terminals also insure that the tantalum channels 54 are a fixed distance from the interior envelope walls thus providing the same evaporation currents and heat sinking from tube to tube. The first insulator member 58 and the second insulator member 72 which are affixed to the dynode assembly 24 also partially shield the dynodes 30–39 within the dynode assembly 24 from direct impingement by alkali vapors generated from the tantalum generators 54. The shielding provided by the aforementioned insulator members prevents excessive alkali deposition on the dynodes and dynode support spacers and thus decreases the electrical background of the photomultiplier tube.

Electrical connections between the stem leads 18 and the above-described components within the envelope 12 are provided by a plurality of connector wires 80, only some of which are shown.

An alternate first evaporator structure 152 is shown in FIGS. 6–8. For clarity, the tantalum channels 54 are not shown in the alternate embodiment. A first insulator member 158, identical to member 58, has two electrical terminals 160 and 162 attached to one surface thereof. As shown in FIG. 7, each of the terminals 160, 162 is substantially M-shaped having a substantially flat central portion which is attached, for example by brazing, to the insulator 158.

A return bus 164 having a corrugated-shaped cross section is affixed to the surface of the insulator 158 and contacts the electrical terminal 160. The return bus 164 bridges the electrical terminal 162 at the point of attachment of the terminal 162 to the insulator member 158 thereby providing a return path to one of the stem leads 18 to permit the evaporation of alkali material from the tantalum channels (not shown) which are attached between the distal ends 165 and 167 of the terminals 160 and 162. Spaced between the terminals 160, 162 is at least one, and preferably two cathode contact support members 166. Each of the cathode contact support members 166 comprises an inverted U-shaped member having a pair of support tabs 168 projecting therefrom which contact and are affixed to the insulator member 158. The cathode contact support members 166 bridge the return bus 164 at a point along the length of the bus where the corrugated-shaped bus 164 is displaced from the surface of the insulator member 158. The aforedescribed evaporator structure 152 maximizes the electrical leakage path between the bus 164, the cathode contact support members 166 and the terminals 160, 162.

A cathode contact member 169 is attached along its length to the support members 166. A distal end of the cathode contact 169 makes spring contact to the aluminum 22 on the inner surface of the envelope 12. Electrical connection between one of the stem leads 18 and the other distal end of the cathode contact 169 is provided by one of the connector wires 80. A pair of clamping members 170 are affixed to the opposite side of the insulator member 158. The clamping members 170 are identical to the clamping members 70 described above and are formed so as to permit attachment to the dynode tabs 42 projecting through the apertures 29 in the support spacers 26 and 28, respectively.

The structure of the alternate embodiments 152 provides longer electrical leakage paths between the above-recited elements which are attached to the insulator member 158 than is provided by the elements of the first evaporator structure 52. Additionally, electrical terminals 160 and 162 provide a resilient contact to the inner surface of the envelope 12 to align the dynode assembly 24 with respect to the inner envelope surface.

What is claimed is:

1. An electron discharge device comprising an evacuated envelope having an interior surface, a photoemissive cathode within said envelope, an electrode assembly having at least one electrode spaced from said cathode, an alkali metal source within said envelope for vapor depositing at least one alkali metal to form said cathode, and evaporator support means including at least one insulator support member attached to said electrode assembly for aligning said electrode assembly with respect to said interior envelope surface, said evaporator support means including at least a pair of electrical terminals attached to said insulator member and to said alkali metal source to provide support thereto and means for evaporating alkali metal therefrom.

2. A photomultiplier tube comprising an evacuated envelope having an interior surface, a photoemissive cathode formed on said interior surface, an anode spaced from said cathode, a dynode assembly including a plurality of dynodes disposed between said cathode and said anode for propagating and concatenating electron emission therebetween, an alkali metal source adjacent to said dynode assembly for vapor depositing at least one alkali metal onto said interior envelope surface to form said cathode, and an evaporator support assembly including a first evaporator support structure, said support structure being attached to said dynode assembly for aligning said dynode assembly with respect to said interior envelope surface, said first evaporator support structure including a first insulator member and at least two spaced apart electrical terminals attached to one surface of said insulator member for supporting said alkali metal source.

3. The tube as in claim 2 wherein each of said dynodes of said plurality of dynodes includes a pair of oppositely disposed dynode mounting tabs.

4. The tube as in claim 3 wherein said dynode assembly further includes a pair of oppositely disposed dynode support spacers having a plurality of elongated apertures extending therethrough, each of said dynode mounting tabs extending through a different one of said apertures for supporting said plurality of dynodes therebetween.

5. The tube as in claim 4 wherein said first evaporator support structure includes at least a pair of first clamping members attached to a surface of said first insulator member opposite the surface to which said electrical terminals are attached for securing said first evaporator support structure to selected ones of said dynode mounting tabs extending through apertures in said dynode support spacers.

6. The tube as in claim 5 wherein said first evaporator support structure further includes a cathode contact assembly electrically insulated from said clamping members and said electrical terminals.

7. The tube as in claim 4 further including an antimony source for depositing antimony onto said interior envelope surface to form said cathode.

8. The tube as in claim 7 wherein said evaporator support assembly further includes a second evaporator support structure, said second evaporator support structure includes a second insulator member, at least a pair of second clamping members attached to a surface of said second insulator member for securing said second member to selected ones of said dynode mounting tabs extending through said apertures in said dynode support spacer and an antimony contact member disposed on a surface of said second insulator member for contacting one end of said antimony source, said contact member being disposed opposite the surface to which said clamping members are attached.

9. The tube as in claim 8 further including a bulb spacing member attached to said antimony contact member.

10. The tube as in claim 2 wherein said first and said second evaporator support structures are disposed on opposite sides of said dynode assembly, adjacent to said dynodes, so as to shield said dynodes from said alkali metal and to provide rigidity to said dynode assembly.

* * * * *